US006293067B1

(12) United States Patent
Meendering

(10) Patent No.: US 6,293,067 B1
(45) **Date of Patent: *Sep. 25, 2001**

(54) TIE FOR FORMS FOR POURED CONCRETE

(76) Inventor: Allen Meendering, P.O. Box 488, Tea, SD (US) 57064

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/040,659

(22) Filed: Mar. 17, 1998

Related U.S. Application Data

(63) Continuation-in-part of application No. 08/756,240, filed on Nov. 26, 1996, now abandoned.

(51) Int. Cl.[7] ..... E04B 2/86
(52) U.S. Cl. ..... 52/426; 52/442
(58) Field of Search ..... 52/426, 428, 442, 52/562, 568, 275, 276, 277; 249/36, 38, 42, 47, 191, 45, 190, 192, 213, 216

(56) References Cited

U.S. PATENT DOCUMENTS

| | | | | |
|---|---|---|---|---|
| 1,035,206 | * | 8/1912 | Lewen | 52/426 |
| 3,292,893 | | 12/1966 | Williams | 249/42 |
| 3,611,664 | * | 10/1971 | Barbera | 52/562 |
| 3,772,842 | * | 11/1973 | Barbera | 52/426 |
| 4,765,109 | | 8/1988 | Boeshart | 52/426 |
| 4,889,310 | | 12/1989 | Boeshart | 240/41 |
| 5,040,344 | * | 8/1991 | Durand | 52/426 |
| 5,209,039 | | 4/1993 | Boeshart | 52/699 |
| 5,611,182 | * | 3/1997 | Spude | 52/426 |
| 5,649,401 | * | 7/1997 | Harrington, Jr. | 249/47 |
| 5,701,710 | * | 12/1997 | Tremelling | 52/426 |

* cited by examiner

*Primary Examiner*—Michael Safavi
(74) *Attorney, Agent, or Firm*—Brian L. Laurenzo; Michael C. Gilchrist

(57) ABSTRACT

A system of preparing a form for the pouring of concrete for foundations and the like. The system includes a series of tracks for holding of forming insulation material or the like. The tracks are held by ties having ends readily attachable to ribs on the tracks for rapid and convenient assembly. The tracks are formed to hold insulating panels in a spaced parallel relationship. The ties and tracks mate together in a holding relation easily engageable.

6 Claims, 3 Drawing Sheets

TIE FOR FORMS FOR POURED CONCRETE

This application is a continuation in part of a former application by the inventor, Ser. No. 08/756,240, filed Nov. 26, 1996, and now abandoned.

BACKGROUND AND SUMMARY OF THE INVENTION

This invention pertains to forms for holding poured concrete being used as basement or other concrete walls, and more particularly to a system for providing such forms quickly, conveniently and at relatively low cost.

Poured concrete walls have been used for many years. Forms into which to pour the concrete to form the walls have undergone many changes during that time. At first, with inexpensive carpenter labor, it was easiest to simply build wooden walls forming a trench between those walls into which the newly-mixed concrete could be poured. Later, re-usable sheet metal forms were developed. These forms could be placed, the concrete poured, and the forms removed so they could be reused.

More recently, systems have been proposed by which slabs of foamed plastic material are held in parallel spaced relation while the concrete is poured into the space between the slabs. With such walls, the plastic forms remain as insulation.

This invention pertains to the latter type of system and provides a much quicker, simpler way of putting the forms together for the preparation of the form for the pouring of the concrete, and a wall more rigid and supportive than previous walls of its type.

DESCRIPTION

Figure 1:
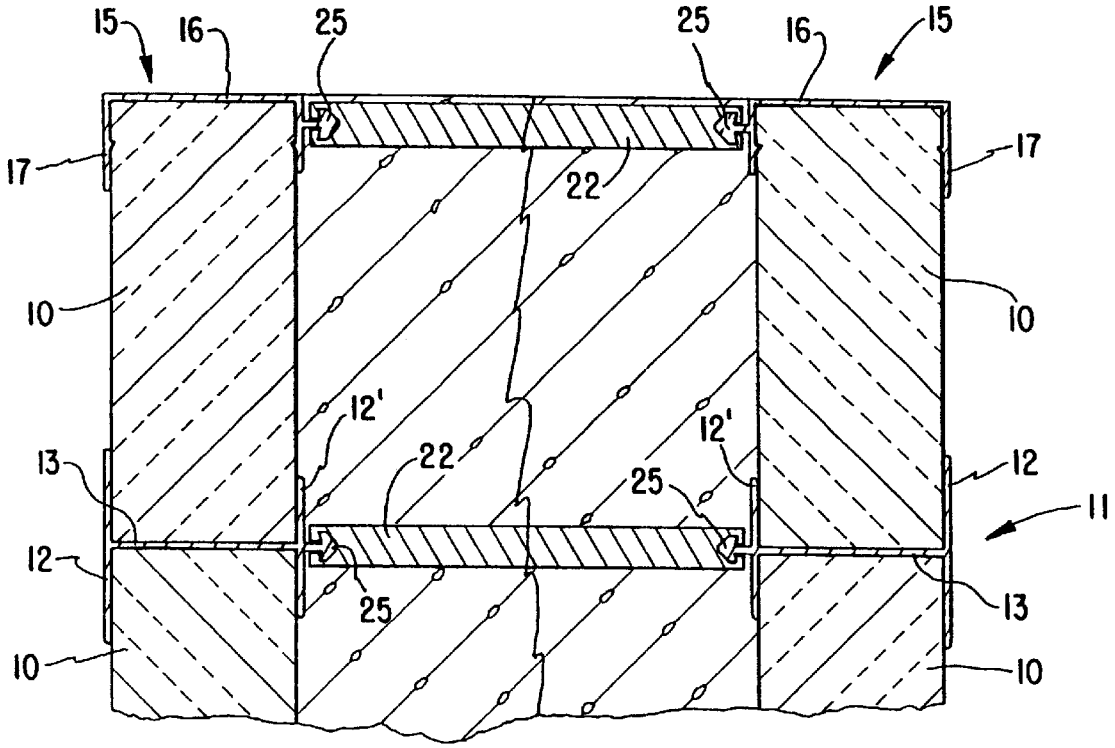
FIG. 1 is a partial cross sectional view of a poured concrete wall using as a base the new system of forms.
Figure 2:
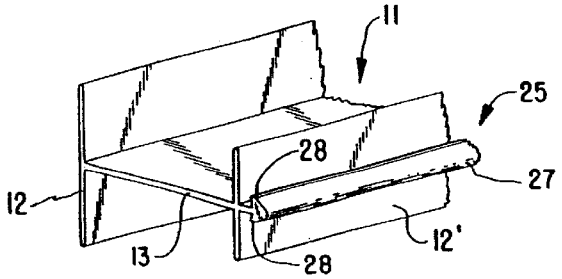
FIG. 2 is a perspective view of one rail of the form used to hold the foamed plastic form member.

Briefly, this invention comprises a system of forms for holding poured concrete to form a wall. The basic form is not new, but the invention provides a convenient and quick system of putting the forms together for use, and provides a rare rigid and supportive wall.

In the construction of insulating forms for the pouring of concrete, it is current practice to use a series of sheets of foamed plastic material to provide the walls for the form. Each wall is formed of such panels held in spaced parallel arrangement by series of ties or spacers, generally being placed in slots at the edges of the sheets of plastic material. A system of this general type is shown in U.S. Pat. No. 4,765,109, issued Aug. 23, 1988; and U.S. Pat. No. 4,889, 310, issued Dec. 26, 1989.

By this present invention, the applicant provides a simplified and improved system for building each wall and tying the walls together to shape the form for pouring the concrete. The use of panels 10 of foamed plastic material is common to both systems. However, in applicant's new system, plain edges not requiring tongue and grooves are used on the panel. These panels are set into tracks 11 of roughly H-shape having outer flanges 12 and inner flanges 12' joined by a web 13. It will be noticed that the formation provides a track or channel unit 11 having an upward opening channel and a downward opening channel, each of which has an inner flange 12 and an outer flange 12' adapted to receive an edge of a panel 10 between said flanges. The flanges are spaced apart to embrace the thickness of the panels 10 so that each panel fits smoothly into the track and is held in line thereby.

At the top and bottom of each side wall, a capping track 15 may be used. This track is channel-shaped having a web 16 exactly like that of the main tracks 11. The outer flanges 17 and inner flanges 17', however, extend only one way from the web, thus forming a familiar channel shape. It is apparent how these strips will cover the top and bottom edges of the walls of the form. The tracks have an extended length which preferably extends the full width of the panel. However, they may be shortened to no less than one-half that width so long as the track crosses the abutting ends of adjacent panels.

Variations in these tracks are shown. For example, in both the H-shaped track 11 and the capping track 15, the flanges 12' and 17' are shown as somewhat narrower than the outer flanges 12 and 17. The reason is principally based on the function of the outer flange. As the concrete is poured, there is considerable pressure pushing outwardly on the forms. Thus, the flanges 12 and 17 on the outside need to be somewhat more resistant than the inner flanges 12' and 17'. Thus these inner flanges may be made somewhat less strong than the outer.

Figure 3:
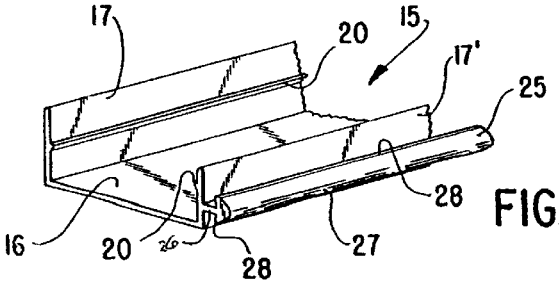
FIG. 3 is a view similar to FIG. 2 of a base or top rail.

Another variation is shown in FIG. 3 where the flanges 17 and 17' are shown having a barbed holding strip 20 of generally triangular cross section running the length of the flange on the side of the flange adjacent the web. These strips 20 when in contact with the panels 10 tend to hold the panels in place so that slight bumps will not displace the panel and destroy the wall. This form greatly stiffens the wall, both by stiffening the flange on which it is formed and by holding the panel more rigidly when that panel is inserted between the flanges.

In order to be useful, the walls formed by the panels 10 and the tracks 11 and 15 must be held in spaced parallel relationship. This is accomplished by the use of ties 22 attached to the tracks by a simplified structure. The ties essentially hold the walls of the forms in a fixed parallel relationship both during the setting up of the forms and during the pouring of the concrete.

To provide for the structure, each of the tracks 11 or the capping tracks 15 is provided with a continuous holding protrusion 25 running along the track 11 (or track 15). A cross-section of the protrusion is shaped as an arrow-head having a shank 26 attached to the track and an arrow point held by the shank. The arrow point has a pointed tip 27 running as an edge parallel to the track, and a pair of barb-shaped portions 28 forming the rear of the point-shape. Thus, the barbs 28 have a surface sloping outward and away from the surface to which the protrusion 25 is attached. This shape is desirable because a mating surface will tend to be held more securely against forces tending to pull the attaching devices apart because of the acute angle at which the surface intersects with the shank 26.

Figure 4:
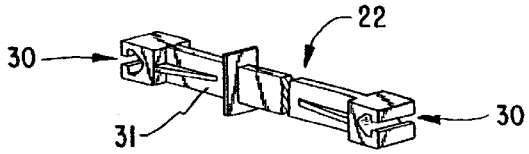
FIG. 4 is a perspective view of a tie used to hold the rails in proper relationship.

The tie 22 which holds the forms together is best shown in FIG. 4. These ties, when fastened, extend a relatively short distance along the tracks 25. Each end of the tie 22 is formed with a mating (female in the illustrated device) slotted hollow 30 which fits over the arrow head protrusion 25 on the tracks 11 and 15. The body 31 of the tie may be a simple bar of proper length to hold the walls of the form in proper relationship as indicated in FIG. 1. Notice that the mating hollow and barb have mirror image cross sections. This mirror image is required for resistance to withdrawal of one from the other.

Figure 5:
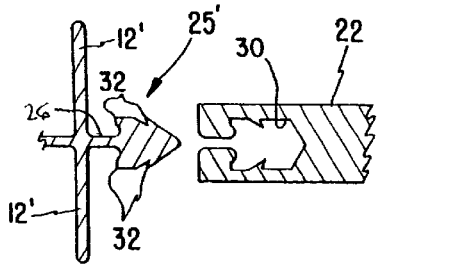
FIG. 5 is a partial sectional view of an alternate end fastening for the ties.

The alternative form shown in FIG. 5 is simply a changed cross sectional form of the protrusion, shown in this figure at 25' and the mating hollow 30'. The changed form uses dual barbs 32 in order to provide a stronger grasp between the male and female formations, when it becomes necessary to hold the walls of the form against greater pressure from the poured concrete. This might happen with walls thicker or higher than usual. The dual barbed tie might also be strong enough so that fewer ties could be used than when the single barbed form is used.

Figure 6:
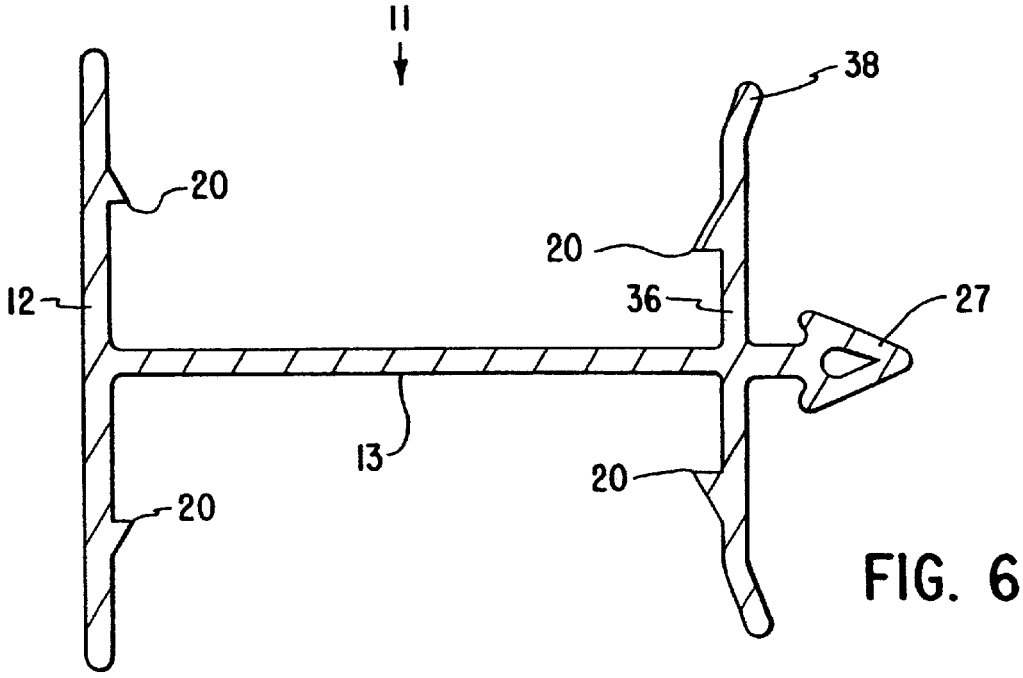
FIG. 6 is a sectional view of the rail in an alternative form usable as a intermediate rail.
Figure 7:
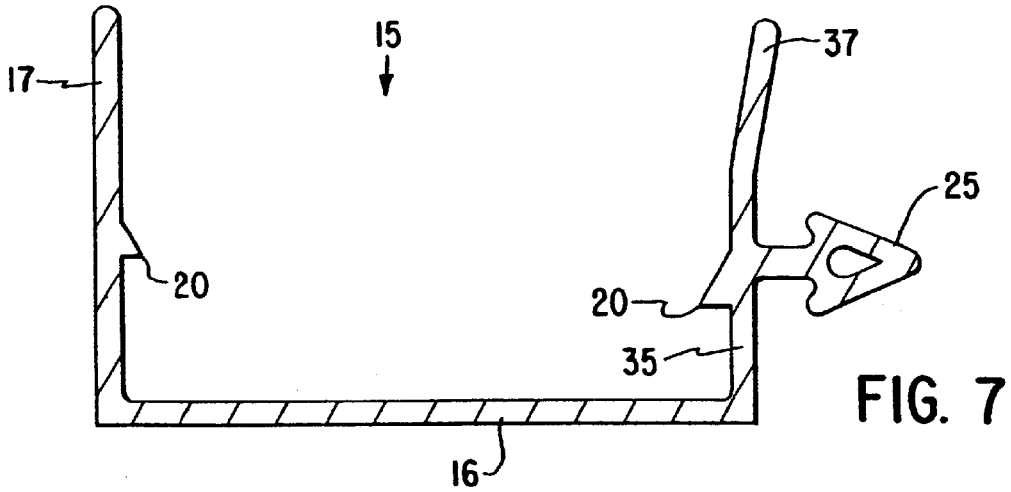
FIG. 7 is a sectional view of the rail in an alternate form, usable as a top and bottom rail.

Still another variation in the cross-sectional shape of the tracks 11 and 15 is shown in FIGS. 6 and 7. These figures show the preferred H-shape and U-shape having interior barbs 20. However, the interior flanges 35 and 36 respectively corresponding to the originally described flanges 17' and 12' respectively are formed with an inner leaning edge portion 37 on the interior flange 35 of the H-shaped cross-section and a similar portion 38 on the flange 36 in the U-shaped cross-sectional track.

The sloped edged portions 37 and 38 are useful in setting up the forms because the panels can be more easily inserted between the walls. Again the object is to ease the operation so that time and energy can be saved and so that the level of necessary skill can be reduced.

It will be recognized that while the ties are shown and described as having the female formation and the protruding strips 25 are described as male formation, that these formations could be reversed without in any way changing the usefulness of the formation of the assembly. Applicant prefers the illustrated arrangement where the tracks 11 and 15 can be made of a relatively rigid plastic and the ties 22 a somewhat more flexible material such as a nylon type plastic so that the entrance to the hollows 30 is somewhat easier to expand. In this way, the ties are somewhat easier to install.

In use, the first tracks - ordinarily base tracks 15—would be placed in parallel spaced relation. Ties 22 along the length of the track would be fastened simply by pressing the male formed part into the hollow 30 of the female form and snapping it into place. By using a continuous strip on the tracks 15, the ties can be placed at either regular or irregular intervals along the track as opposed to systems requiring openings in the panels. This flexibility is a real time-saving expedient when setting up the walls. The panels 10 are then placed in the channel form of the base track 15 and are topped by an H-shaped track 11. Successive panels can then be built up till the form is as high as desired and then capped with a cap track 15. In each layer, ties 22 should be fastened horizontally between the adjacent tracks to hold the walls in place. When the capping tracks have been placed and tied together, the concrete can be poured between the panel-walls and allowed to set, thus forming a poured concrete wall having insulating panels both inside and outside.

By using the continuous tracks 11 and 15, the joints between the styrofoam panels are considerable strengthened and are made much more rigid. Where walls of forms in former types of assembly are held by ties and therefore allow flexing between walls unless extra care is used in the placement of ties, applicant's wall is relatively rigid. Walls formed by use of the tracks 11 and 15 will withstand much greater wind than previously formed walls before pouring. This is of particular benefit where it is necessary to prepare a form in one day for use in receiving poured concrete the following day—a common occurrence in many jobs because of the time required for the pour.

I claim as my invention:

1. Apparatus for forming a poured, generally vertical concrete wall, comprising:

a first pair of generally U-shaped, longitudinally extending members spaced laterally apart from each other;

first longitudinally extending panel members of a predetermined width and selected material received into said U-shaped members and providing an upper edge;

a first pair of generally H-shaped, longitudinally extending members, each providing a pair of opposed cavities having one cavity thereof positioned on and receiving said upper edge of one of said panel members and positioned to receive additional panel members in the opposite cavity thereof;

second longitudinally extending panel members receivable into said opposite cavity of said H-shaped members to be in substantially vertical relation with said first longitudinally extending panel members;

additional pairs of H-shaped members and panel members arranged in sequential vertical relation to one another to a desired wall height having panel edges exposed at such height;

a second pair of U-shaped members positioned on and receiving said exposed panel edges at said desired wall height;

said first pair and each additional pair of H-shaped members being provided with connector members on one side thereof whereby said connector members of said first pair and each of said additional pairs of said H-shaped members are in opposed relation to each other;

extending tie members having connector means on the ends thereof in operable connection with said connector members of said H-shaped members whereby said H-shaped members and said panels are held in spaced relation to provide a concrete receiving cavity therebetween; and said connector members of said H-shaped members including an arrowhead connection element.

2. The apparatus as set forth in claim 1 wherein said second pair of U-shaped members includes an arrowhead connection on one side thereof arranged and constructed for connection to said connectable arrowhead element of said tie members whereby said second pair of U-shaped members are held in spaced apart relation.

3. An assembly for use in creating a form for pouring concrete, said assembly comprising:

a first wall formed by a first plurality of abutting panels and a first plurality of channels, each of said panels in said first plurality of abutting panels having horizontal edges and vertical edges, each of said channels in said first plurality of channels having internal flanges, said internal flanges of said channels in said first plurality of channels each having an internal surface, said channels in said first plurality of channels engaging said horizontal edges of said panels in said first plurality of abutting panels to hold said vertical edges of said panels in said first plurality of abutting panels in alignment with said vertical edges of an adjacent abutting panel in said first plurality of abutting panels;

a second wall formed by a second plurality of abutting panels and a second plurality of channels, each of said panels in said second plurality of abutting panels having horizontal edges and vertical edges, each of said channels in said second plurality of channels having internal flanges, said internal flanges of said channels in said second plurality of channels each having an internal surface, said channels in said second plurality of channels engaging said horizontal edges of said panels in said second plurality of abutting panels to hold said vertical edges of said panels in said second plurality of abutting panels alignment with said vertical edges of an adjacent abutting panel in said second plurality of abutting panels, said second wall being parallel to and spaced apart from said first wall such that said internal surfaces of said internal flanges of said first and second channels face each other;

a first holding track extending from said internal surfaces of said internal flanges of said first plurality of channels, said first holding track having a first arrowhead cross-section;

a second holding track extending from said internal surfaces of said internal flanges of said second plurality of channels, said second holding track having a second arrowhead cross-section, said holding track extending towards said first holding track; and a tie having a first end and a second end, said first end of said tie having mating means for engaging said first arrowhead cross-section of said first holding track and said second end of said tie having mating means for engaging said second arrowhead cross-section of said second holding track.

4. The assembly of claim 3, wherein each of said arrowhead cross-sections includes a plurality of barbs.

5. A spacing assembly for use in an assembly for pouring concrete walls, the assembly for pouring concrete walls being of the type having two sets of panels in a spaced parallel opposing relationship, the spacing assembly being adapted to hold the panels in the spaced parallel opposing relationship, the spacing assembly comprising:

a first track having a first inner flange and a first outer flange, said first inner flange and said first outer flange being spaced apart from each other to form a first channel and being adapted to receive and hold one of the panels in said first channel, said first inner flange having a first inner face facing away from said first outer flange;

a second track having a second inner flange and a second outer flange, said second inner flange and said second outer flange being spaced apart from each other to form a second channel and being adapted to receive and hold one of the panels in said second channel, said second inner flange having a second inner face facing away from said second outer flange, said second track being spaced apart from said first track with said second inner face being opposed to and facing said first inner face;

a first continuous strip extending from said first inner face, said first continuous strip having a first continuous arrowhead cross-section;

a second continuous strip extending from said second inner face, said second continuous strip having a second continuous arrowhead cross-section;

a tie device having a first end and a second end, said first end of said tie device in mating engagement with said first arrowhead cross-section, said second end of said tie device in mating engagement with said second arrowhead cross-section.

6. The spacing assembly of claim 5 in which each of said arrowhead cross-sections includes a shank, said arrowhead cross-sections also having a pointed end having barbs, each of said barbs including surfaces engaging said shanks at acute angles.

* * * * *